US008556123B2

(12) United States Patent
Py et al.

(10) Patent No.: US 8,556,123 B2
(45) Date of Patent: Oct. 15, 2013

(54) CONTAINER AND ONE-WAY VALVE ASSEMBLY FOR STORING AND DISPENSING SUBSTANCES, AND RELATED METHOD

(75) Inventors: Daniel Py, Stamford, CT (US); Julian V. Chan, Spring Valley, NY (US); Giovanni Rodriguez, Stamford, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 0 days.

(21) Appl. No.: 12/962,087

(22) Filed: Dec. 7, 2010

(65) Prior Publication Data

US 2011/0073614 A1 Mar. 31, 2011

Related U.S. Application Data

(63) Continuation of application No. 11/008,887, filed on Dec. 9, 2004, now Pat. No. 7,845,517.

(60) Provisional application No. 60/528,429, filed on Dec. 10, 2003, provisional application No. 60/539,602, filed on Jan. 27, 2004.

(51) Int. Cl.
*B67D 1/00* (2006.01)

(52) U.S. Cl.
USPC ..... 222/83.5; 222/81; 222/212; 222/213; 222/491; 222/494

(58) Field of Classification Search
USPC ..... 222/83.5, 80–81, 153.07, 209, 212, 222/213, 215, 490–491, 494, 562, 541.2, 222/525, 541.4, 541.5, 541.9; 137/512, 137/512.4, 512.15
See application file for complete search history.

(56) References Cited

U.S. PATENT DOCUMENTS 2,128,035 A 8/1938 Boetel
2,585,253 A 2/1952 Kochner
(Continued)

FOREIGN PATENT DOCUMENTS

EP 0649795 B1 6/1999
EP 0673852 B1 2/2000
WO WO 03/095325 A1 11/2003

OTHER PUBLICATIONS

International Search Report dated Jul. 26, 2004 from PCT/US03/25487.

(Continued)

*Primary Examiner* — Frederick C Nicolas
(74) *Attorney, Agent, or Firm* — McCarter & English, LLP

(57) ABSTRACT

A device for storing and dispensing a substance includes a container having a body defining therein a storage chamber for receiving and storing the substance. The container includes a head located at one end of the body and a first passageway that is in fluid communication with the storage chamber of the body and defines a flow path therebetween. The container also includes a pierceable wall located on an opposite side of the passageway relative to the storage chamber, and a first connecting portion for connecting another component thereto. The device also includes a one-way valve assembly that includes a valve body including a body base defining a second passageway and at least one piercing portion engageable with the pierceable wall of the container. The valve assembly includes a second connecting portion connectable to the first connecting portion of the container for fixedly securing the valve assembly to the container.

16 Claims, 16 Drawing Sheets

(56) References Cited

U.S. PATENT DOCUMENTS

| | | | | | |
|---|---|---|---|---|---|
| 2,650,740 | A | | 9/1953 | Hammerstein | |
| 3,412,910 | A | | 11/1968 | Hahn | |
| 3,519,157 | A | * | 7/1970 | Meierhoefer | 215/11.6 |
| 3,648,903 | A | | 3/1972 | Marchant | |
| 3,669,323 | A | | 6/1972 | Harker et al. | |
| 3,963,814 | A | | 6/1976 | Cospen et al. | |
| 4,002,516 | A | | 1/1977 | Gaborieau et al. | |
| 4,102,476 | A | | 7/1978 | Loeffler | |
| 4,141,474 | A | | 2/1979 | Nilson | |
| 4,469,249 | A | * | 9/1984 | Malpas et al. | 222/83 |
| 4,513,891 | A | | 4/1985 | Hain et al. | |
| 4,570,826 | A | | 2/1986 | Fattori | |
| 4,696,415 | A | | 9/1987 | Meshberg | |
| 4,699,300 | A | | 10/1987 | Blake | |
| 4,706,827 | A | | 11/1987 | Cabernoch et al. | |
| 4,722,449 | A | * | 2/1988 | Dubach | 215/235 |
| 4,737,148 | A | | 4/1988 | Blake | |
| 4,739,906 | A | | 4/1988 | LoTurco | |
| 4,842,165 | A | | 6/1989 | Van Coney | |
| 4,895,279 | A | | 1/1990 | Schultz | |
| 4,923,480 | A | | 5/1990 | Monestere | |
| 4,949,877 | A | | 8/1990 | Hanna et al. | |
| 4,978,036 | A | | 12/1990 | Burd | |
| 5,033,647 | A | | 7/1991 | Smith et al. | |
| 5,083,416 | A | | 1/1992 | Schneider et al. | |
| 5,102,010 | A | | 4/1992 | Osgar et al. | |
| 5,108,007 | A | | 4/1992 | Smith et al. | |
| 5,178,300 | A | | 1/1993 | Haviv et al. | |
| 5,197,638 | A | | 3/1993 | Wood | |
| 5,226,568 | A | | 7/1993 | Newton et al. | |
| 5,228,592 | A | * | 7/1993 | Pellerano | 222/83 |
| 5,310,094 | A | | 5/1994 | Martinez et al. | |
| 5,312,018 | A | | 5/1994 | Evezich | |
| 5,318,204 | A | | 6/1994 | Davis et al. | |
| 5,320,256 | A | | 6/1994 | Wood | |
| 5,320,845 | A | | 6/1994 | Py | |
| 5,332,121 | A | | 7/1994 | Schmidt et al. | |
| 5,339,972 | A | | 8/1994 | Crosnier et al. | |
| 5,416,303 | A | | 5/1995 | Grooms et al. | |
| 5,489,026 | A | | 2/1996 | D'Aloia | |
| 5,489,027 | A | | 2/1996 | Goerigk | |
| 5,497,910 | A | | 3/1996 | Meadows et al. | |
| 5,556,678 | A | | 9/1996 | Jupin et al. | |
| 5,564,596 | A | | 10/1996 | Meadows et al. | |
| 5,582,330 | A | | 12/1996 | Iba | |
| 5,609,273 | A | | 3/1997 | Firestone et al. | |
| 5,664,704 | A | | 9/1997 | Meadows et al. | |
| 5,692,651 | A | | 12/1997 | Fuchs | |
| 5,718,334 | A | | 2/1998 | Demel | |
| 5,727,892 | A | | 3/1998 | Baudin | |
| 5,730,322 | A | | 3/1998 | Iba et al. | |
| 5,743,441 | A | | 4/1998 | Baudin et al. | |
| 5,746,728 | A | | 5/1998 | Py | |
| 5,759,218 | A | | 6/1998 | Martin et al. | |
| 5,799,837 | A | | 9/1998 | Firestone et al. | |
| 5,823,397 | A | | 10/1998 | Gil | |
| 5,855,302 | A | | 1/1999 | Fisscher | |
| 5,875,936 | A | | 3/1999 | Turbett et al. | |
| 5,899,624 | A | | 5/1999 | Thompson | |
| 5,921,989 | A | | 7/1999 | Deacon et al. | |
| 5,934,500 | A | | 8/1999 | Cogger et al. | |
| 5,944,702 | A | | 8/1999 | Py | |
| 6,032,101 | A | | 2/2000 | Freedman et al. | |
| 6,045,004 | A | * | 4/2000 | Elliott | 222/83 |
| 6,050,444 | A | | 4/2000 | Sugg | |
| 6,053,370 | A | | 4/2000 | Ludbrook et al. | |
| 6,062,437 | A | | 5/2000 | Mascitelli | |
| 6,083,450 | A | | 7/2000 | Safian | |
| 6,145,707 | A | | 11/2000 | Baudin | |
| 6,170,705 | B1 | | 1/2001 | Schneider et al. | |
| RE37,047 | E | | 2/2001 | Py | |
| 6,202,901 | B1 | | 3/2001 | Gerber et al. | |
| 6,254,579 | B1 | | 7/2001 | Cogger et al. | |
| 6,267,768 | B1 | | 7/2001 | Deacon et al. | |
| 6,283,976 | B1 | | 9/2001 | Portney | |
| 6,301,767 | B1 | | 10/2001 | Granger et al. | |
| 6,306,423 | B1 | | 10/2001 | Donovan et al. | |
| 6,312,708 | B1 | | 11/2001 | Donovan | |
| 6,325,253 | B1 | | 12/2001 | Robinson | |
| 6,351,924 | B1 | | 3/2002 | Gustafsson et al. | |
| 6,383,509 | B1 | | 5/2002 | Donovan et al. | |
| 6,386,395 | B1 | | 5/2002 | Lunghetti | |
| 6,428,545 | B2 | | 8/2002 | Portney | |
| 6,446,844 | B1 | | 9/2002 | Gross | |
| 6,450,994 | B1 | | 9/2002 | Boyles et al. | |
| 6,659,308 | B1 | * | 12/2003 | Kelder et al. | 222/83 |
| 6,662,977 | B2 | | 12/2003 | Gerber et al. | |
| 6,761,286 | B2 | | 7/2004 | Py et al. | |
| 6,918,710 | B2 | * | 7/2005 | Budds et al. | 401/132 |
| 7,114,635 | B2 | | 10/2006 | Yamada | |
| 7,845,517 | B2 | * | 12/2010 | Py et al. | 222/83.5 |
| 2002/0017294 | A1 | | 2/2002 | Py | |
| 2002/0074362 | A1 | | 6/2002 | Py et al. | |
| 2003/0106911 | A1 | | 6/2003 | Adams et al. | |
| 2004/0112925 | A1 | | 6/2004 | Py et al. | |
| 2005/0121477 | A1 | | 6/2005 | Scott | |
| 2005/0150903 | A1 | | 7/2005 | Py et al. | |

OTHER PUBLICATIONS

International Search Report dated Dec. 23, 2005 from PCT/US04/41369.

International Search Report from International Application No. PCT/US2006/042159, mailed Oct. 26, 2007.

* cited by examiner

CONTAINER AND ONE-WAY VALVE ASSEMBLY FOR STORING AND DISPENSING SUBSTANCES, AND RELATED METHOD

CROSS-REFERENCE TO RELATED APPLICATIONS

This patent application is a continuation of U.S. patent application Ser. No. 11/008,887, filed Dec. 9, 2004, now U.S. Pat. No. 7,845,517 and claims the benefit of U.S. Provisional Patent Application Ser. No. 60/528,429, filed Dec. 10, 2003 and U.S. Provisional Patent Application Ser. No. 60/539,602, filed Jan. 27, 2004, which are hereby expressly incorporated by reference as part of the present disclosure.

FIELD OF THE INVENTION

The invention relates to kits, containers and other apparatus and related method for storing and dispensing substances, such as creamy, liquid, or pasty substances.

BACKGROUND OF THE INVENTION

Flexible tubes are used to store a variety of powder, liquid, gel, creamy and pasty products having a broad range of viscosities. Generally, the flexible tubes have a cover which is removed to expose a simple release aperture. As a result, low pressure is required to express the contents therein. Undesirable oozing and collection of product that can clog the release aperture is common. Moreover, when the traditional tube is opened, the contents are not only subject to the environment but a quantity of air is normally sucked into the tube. Hence, despite techniques for sterilizing foodstuffs and other products, even the use of preservatives cannot prevent degradation of many products, thereby limiting the shelf-life and range of products suitable for dispensing via tubes. For tubes which dispense multiple doses, even refrigeration after opening cannot prevent the subsequent degradation of the product. The perishable item still has a limited shelf life. In view of the above, one solution has been to provide sterile servings in smaller, portable quantities, such as individual serving packets of ketchup, mustard and mayonnaise.

Similarly, many cosmetic, dermatological, pharmaceutical and/or cosmeceutical products and other substances are packaged in dispensers or other containers that expose the product to air after opening and/or initially dispensing the product. As a result, such products must include preservatives in order to prevent the product remaining in the container from spoiling or otherwise degrading between usages. In addition, such products typically must be used within a relatively short period of time after opening in order to prevent the product from spoiling or otherwise degrading before use. One of the drawbacks associated with preservatives is that they can cause an allergic or an otherwise undesirable reaction or effect on the user. In addition, the preservatives do not prevent the bulk product stored within the open container from collecting, and in some cases, facilitating the growth of germs. Many such prior art dispensers expose the bulk product contained within the dispenser after opening to air, and thus expose the bulk product to bacteria, germs and/or other impurities during and/or after application of the product, thereby allowing contamination of the product remaining in the dispenser and spreading of the bacteria, germs or impurities with subsequent use of the product. For example, liquid lipstick is particularly poorly suited for dispensing by prior art containers. The liquid lipstick becomes contaminated, evaporates due to air passage losing moisture, and ultimately is unusable if not unsafe before complete utilization of the product. The tips become contaminated, dirty and sticky or crusty as well as allowing the lipstick to continue to flow when not being used.

Moreover, certain types of products, such as those that require regulatory approval, may require approval of the product's container. Thus, it is desirable if the container would remain substantially the same so that additional testing and approvals would not be required for a new container.

In view of the above, several containers have been provided with closure devices such as one-way valves. One drawback associated with prior art dispensers including one-way valves is that the valves are frequently designed to work with mechanical pumps or like actuators that are capable of creating relatively high valve opening pressures. Exemplary dispensers of this type are illustrated in U.S. Pat. Nos. RE 37,047, 6,032,101, 5,944,702, and 5,746,728 and U.S. Publication Nos. US2002/0074362 A1, US2002/0017294 A1. Squeeze tube-type dispensers, on the other hand, are not capable of creating the necessary valve opening pressures, and therefore such prior art valves do not work effectively with squeeze tubes.

Accordingly, an aspect of the present invention is to overcome one or more of the above-described drawbacks and disadvantages of the prior art.

SUMMARY OF THE INVENTION

Exemplary embodiment of the invention include a device for storing and dispensing a substance. The device includes a container having a body defining therein a storage chamber for receiving and storing the substance and a head located at one end of the body. There is a first passageway that is in fluid communication with the storage chamber of the body and defines a flow path therebetween. The container includes a pierceable wall located on an opposite side of the passageway relative to the storage chamber, and a first connecting portion for connecting another component thereto.

The device further includes a one-way valve assembly that includes a valve body having a body base defining a second passageway and at least one piercing portion engageable with the pierceable wall of the container, wherein the at least one of the piercing portion of the valve assembly and the pierceable wall of the container is movable relative to the other between a first position wherein the pierceable portion is not piercing the pierceable wall, and a second position wherein the pierceable portion is piercing the pierceable wall and the first passageway of the container is in fluid communication with the second passageway of the valve body for allowing the flow of substance from the storage chamber therethrough. The valve assembly also includes a second connecting portion that is connectable to the first connecting portion of the container for fixedly securing the valve assembly to the container when the valve assembly and container are located in the second position.

The valve assembly further includes a valve seat and at least one flow aperture extending through the valve body adjacent to the valve seat and in fluid communication with the second passageway for receiving the substance from the storage chamber therethrough. The valve assembly also includes a valve cover including a cover base mounted on the body base and fixedly secured against axial movement relative thereto. A valve portion overlies the valve seat, wherein the valve portion defines a predetermined radial thickness and a diameter less than a diameter of the valve seat to thereby form an interference fit passageway therebetween.

Exemplary embodiments of the invention also include a method that includes providing a one way valve assembly having a piercing member and providing a container having a piercable wall. The method further includes securing the valve assembly to the container so that the valve assembly and the container are located in a first position, moving the valve assembly and the container relative to each other to a second position, and piercing the piercable wall with the piercable member so that the valve assembly and an interior of the container are in fluid communication with each other.

DETAILED DESCRIPTION OF THE PREFERRED EMBODIMENTS

Figure 1:
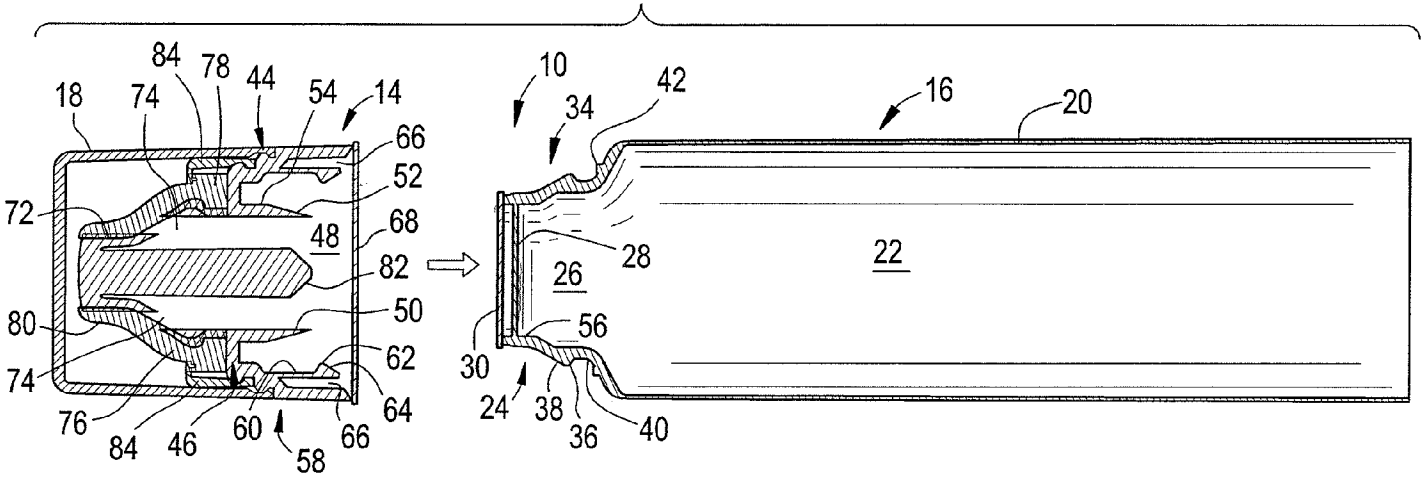
FIG. 1 is a cross-sectional view of a kit including a container and a cap and one-way valve assembly that is connectable to the container for piercing the container and dispensing substances therefrom.

Referring to FIGS. 1-4, a kit including a one-way valve assembly and container embodying the present invention is indicated generally by the reference numeral 10. While the exemplary embodiments illustrate a tubular container, it is understood that any shaped container is contemplated. The kit 10 includes a one-way valve assembly 14 that is connectable in fluid communication with a container 16. A cap 18 is releasably connected to the valve assembly 14 for covering the valve assembly when not in use.

The container 16 comprises a body 20 defining therein a storage chamber 22 for receiving and storing a substance. The substance includes products that are creamy, pasty, liquid, or other such substance. In an exemplary embodiment, the substance includes any of numerous different types of cosmetics, such as eye and lip treatments, including, for example, lip gloss, eye colors, eye glaze, eye shadow, lip color, moisturizers and make-up, such as cover-up, concealer, shine control, mattifying make-up, and line minimizing make-up, personal care items such as lotions, creams and ointments, oral care items such as toothpaste, mouth washes and/or fresheners, pharmaceutical products such as prescription and over-the-counter drugs, dermatological products, such as products for treating acne, rosacea, and pigmentation disorders, cosmeceutical products, such as moisturizers, sunscreens, anti-wrinkle creams, and baldness treatments, nutraceuticals, other over-the-counter products, household items such as adhesives, glues, paints and cleaners, industrial items such as lubricants, dyes and compounds, and food items such as icing, cheese, yogurt, milk, tomato paste, and baby food, and condiments, such as mustard, ketchup, mayonnaise, jelly and syrup. As may be recognized by those of ordinary skill in the pertinent art based on the teachings herein, this list is intended to be exemplary and in no way limiting.

The container includes any type of container that can hold the substance. For instance, the body 20 of the container may be made of material. In an exemplary embodiment, the body 20 may be all plastic, aluminum, a combination thereof, and/or a plurality of other suitable materials well known to those skilled in the art now and later discovered. In another exemplary embodiment, the body 20 is made from a coextruded sheet containing various combinations of LDPE, LLDPE, HDPE, tie resins and foil. The body 20 can be customized for the application, for example, by color, shape, decoration, coatings and the like. Additionally, the container 16 can be sized to be portable or otherwise as may be desired. The body 20 also provides a barrier to oxygen, moisture, flavor loss and the like.

In these exemplary embodiments, the body 20 may be squeezed in a conventional manner, such as squeezing the body on opposites sides relative to each other and, in turn, transmitting a substantially radially-directed force into the body. By squeezing the body, the pressure of the product or other substance contained within the body is increased until the pressure is great enough to push the product out the valve assembly 14.

In another exemplary embodiment, the container 16 may include a more rigid body and a flexible bladder located in the container that holds the substance, such as that disclosed in U.S. Pat. No. 6,761,286, which is hereby expressly incorporated by reference as part of the present disclosure.

Figure 3:
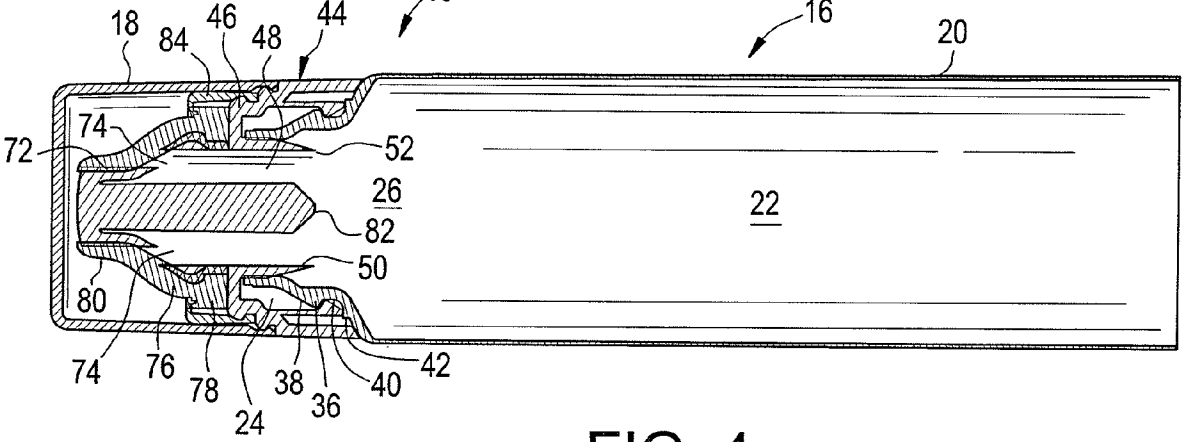
FIG. 3 is a cross-sectional view of the kit of FIG. 1 illustrating the cap and valve assembly connected in fluid communication to the container for dispensing substances therefrom.
Figure 4:
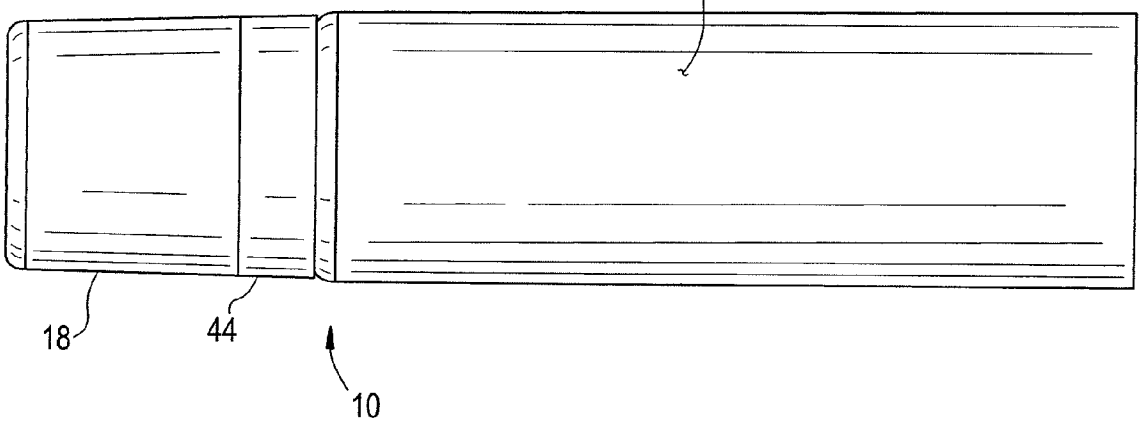
FIG. 4 is a side elevational view of the kit of FIG. 3.

The container 16 includes a head 24 that is located at one end of the body 20. A first axially-extending passageway 26 is coupled in fluid communication with the storage chamber 22 of the body 20 and defines an unobstructed axially-extending flow path therebetween. A pierceable wall 28 is located on the opposite side of the axially-extending passageway 26 relative to the storage chamber 22. As shown in FIG. 1, the pierceable wall 28 is normally closed to hermetically seal the substance in the storage chamber 22. However, as shown in FIG. 3 and described further below, the pierceable wall 28 is pierceable to break the seal and allow substance to flow from the storage chamber 22 therethrough.

Figure 2:
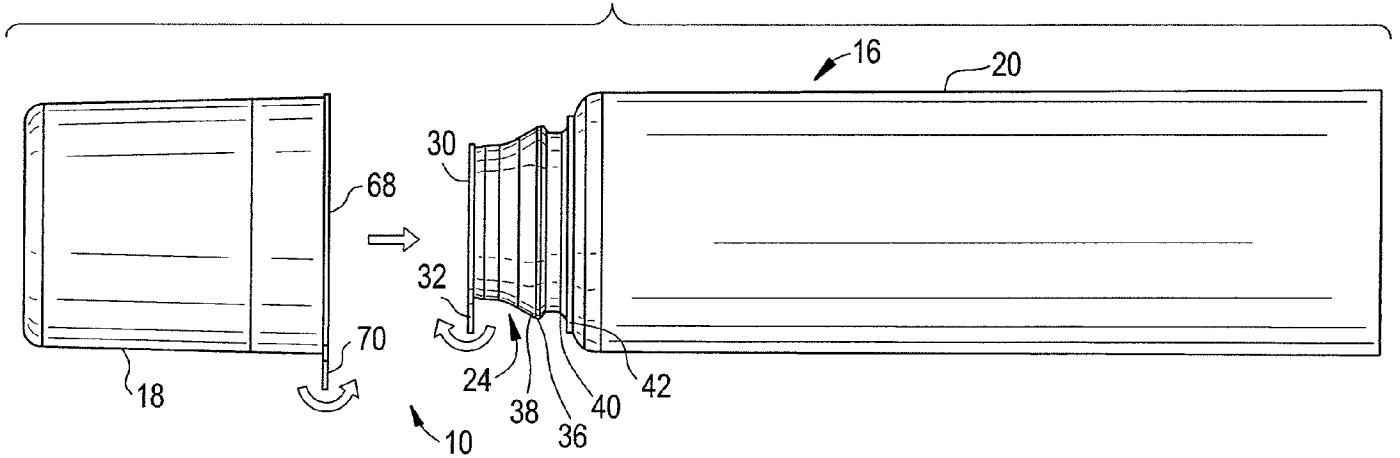
FIG. 2 is a side elevational view of the kit of FIG. 1 illustrating the components of the kit prior to connecting the valve assembly in fluid communication with the container.

As shown in FIGS. 1 and 2, a first releasable sealing member 30 is releasably connected to the head 24 of the container 16 and overlies the pierceable wall 28 for substantially preventing contamination of the pierceable wall during storage. As indicated by the arrow in FIG. 2, the first releasable sealing member 30 includes a radially projecting tab 32 that can be gripped by a user to peel away the first releasable sealing member prior to connecting the valve assembly to the container. The first releasable sealing member 30 may take the form, for example, of a foil disk including an adhesive backing portion for sealing and releasably connecting the first releasable sealing member to the container. However, as may be recognized by those of ordinary skill in the pertinent art, the first releasable sealing member may take any of numerous different forms or configurations that are currently or later become known for performing the functions of the releasable sealing member as described herein.

The container 16 further includes a first connecting portion 34 for connecting the valve assembly 14 thereto. In the illustrated embodiment, the first connecting portion 34 includes an annular raised portion or first lobe 36, a first tapered surface 38 that tapers radially outwardly on one side of the first lobe 36, and an annular recess 40 axially spaced on the opposite side of the first lobe relative to the first tapered surface 38. An annular stop surface 42 is axially spaced on the opposite side of the annular recess 40 relative to the first lobe 36.

The one-way valve assembly 14 comprises a valve body 44 including a body base 46 defining a second axially-extending passageway 48 connectable in fluid communication with the first axially-extending passageway 26 of the container 16. A piercing portion 50 of the valve assembly is engageable with the pierceable wall 28 of the container 16. In the illustrated embodiment, at least one of the piercing portion 50 of the valve assembly 16 and the pierceable wall 28 of the container 16 is movable relative to the other between a first position, shown typically in FIG. 1, wherein the piercing portion 50 is not piercing the pierceable wall 28, and a second position, shown typically in FIG. 3, wherein the pierceable portion 50 pierces and extends through the pierceable wall, and the first axially-extending passageway 26 of the container 16 is connected in fluid communication with the second axially-extending passageway 48 of the valve body 44 for allowing the flow of substance from the storage chamber 22 therethrough.

Also in the illustrated embodiment, the piercing portion 50 defines an annular, axially-extending piercing surface 52 that projects into the first axially-extending passageway 26 upon movement from the first position, shown typically in FIG. 1, to the second position, shown typically in FIG. 3. As shown in FIGS. 1 and 3, the piercing surface 52 tapers radially inwardly when moving in the axial direction toward the storage chamber 22. The valve body 44 further defines a first annular sealing surface 54 formed at the base of the piercing surface 52 that is engageable with the head 24 of the container 16 for forming a fluid-tight seal therebetween when the valve assembly and container are located in the second position to thereby effect a hermetic seal between the valve assembly and container when in the second position. More particularly, the head 24 of the container 16 includes a second annular sealing surface 56 (FIG. 1) that is engageable with, and forms an interference fit with the first sealing surface 54 to thereby form an annular fluid-tight seal therebetween.

The valve assembly 14 further includes a second connecting portion 58 that is connectable to the first connecting portion 34 of the container 16 for fixedly securing the valve assembly 14 to the container 16 when the valve assembly and container are located in the second position (FIG. 3). In the illustrated embodiment, the second connecting portion 58 includes a plurality of axially-extending connecting flanges 60 angularly spaced relative to each other, and each defining on the free end thereof a second annular lobe 62 and radially-inwardly tapering surface 64. An annular gap 66 is formed between the exterior wall of the body base 46 and the connecting flanges 60 to permit the connecting flanges to flex radially outwardly during connection to the tube.

The valve assembly 14 further includes a second releasable sealing member 68 that is releasably connected to the body base 46 and overlies the piercing portion 50 for substantially preventing contamination of the piercing portion during storage, and is removable therefrom prior to connecting the valve assembly 14 to the container 16. As indicated by the arrow in FIG. 2, the second releasable sealing member 68 includes a radially projecting tab 70 that can be gripped by a user to peel away the second releasable sealing member prior to connecting the valve assembly to the container. The second releasable sealing member 68 may take the form, for example, of a foil disk including an adhesive backing portion for sealing and releasably connecting the second releasable sealing member to the valve assembly. However, as may be recognized by those of ordinary skill in the pertinent art based on the teachings herein, the second releasable sealing member may take any of numerous different forms or configurations that are currently or later become known for performing the functions of the releasable sealing member as described herein.

In order to connect the valve assembly 14 to the tube 16, and as indicated by the arrows in FIGS. 1 and 2, the second releasable sealing member 68 is removed from the valve assembly 14 to expose the piercing portion 50 thereof, and the first releasable sealing member 30 is removed from the container 16 to expose the pierceable portion or end wall 28 thereof. Then, as indicated by the arrow in FIG. 1, the valve assembly 14 is moved toward the container (or vice versa) from the first position, shown typically in FIG. 1, to the second position shown typically in FIG. 3. When moving axially from the first into the second position, the piercing surface 52 of the piercing portion 50 pierces or breaks through the pierceable end wall 28 of the container and, in turn, connects the first axially-extending passageway 26 of the container in fluid communication with the second axially-extending passageway 48 of the valve assembly. Also in the second position, the first annular sealing surface 54 of the valve assembly sealingly engages the second annular sealing surface 56 of the tube head to form a fluid-tight or hermetic seal therebetween.

The valve body 46 further includes an axially-extending valve seat 72 and a plurality of angularly-extending flow apertures 74 axially extending through the valve body adjacent to the valve seat and coupled in fluid communication with the second axially-extending passageway 48 for receiving the substance from the storage chamber 22 therethrough. The valve assembly 14 further includes a valve cover 76 that is formed of an elastic material and includes a cover base 78 mounted on the body base 46 and fixedly secured against axial movement relative thereto, and a valve portion 80 overlying the valve seat 72. The valve portion 80 defines a predetermined radial thickness and a diameter less than a diameter of the valve seat 72 to thereby form an interference fit therebetween (as indicated by the overlying lines in FIG. 1), and the valve portion and the valve seat define a normally closed, annular, axially-extending valve opening therebetween. The valve portion 80 is movable radially between a normally closed position with the valve portion engaging the valve seat 72, and an open position with at least a segment of the valve portion spaced radially away from the valve seat to allow the passage of substance therebetween. The valve seat and valve cover are essentially the same as one or more embodiments disclosed in the above-mentioned co-pending patent application, and further detailed features thereof are described further therein.

The valve assembly 14 further includes a substance displacing portion 82 that extends axially into at least one of the first and second axially-extending passageways 26 and 48, respectively, when located in the second position to, in turn, displace substance through at least one of the flow aperture 74 and valve assembly to thereby cause a predetermined amount of substance within the axially-extending passageways to be dispensed upon connecting the valve assembly to the container. One advantage of this feature is that if the piercing portion 50 or pierceable portion 28 becomes contaminated upon removing the respective releasable sealing members, any substance so contaminated will be automatically dispensed through the valve assembly upon connecting the valve assembly to the container. As a result, the interior of the container, and the bulk substance contained within the storage chamber 22, will be maintained in a sterile (if desired), non-contaminated condition throughout the usage of the kit.

The valve assembly further includes a securing ring 84 that extends about the periphery of the base 78 of the valve cover to fixedly secure the valve cover to the valve body and prevent removal of the valve cover therefrom.

Figure 5:
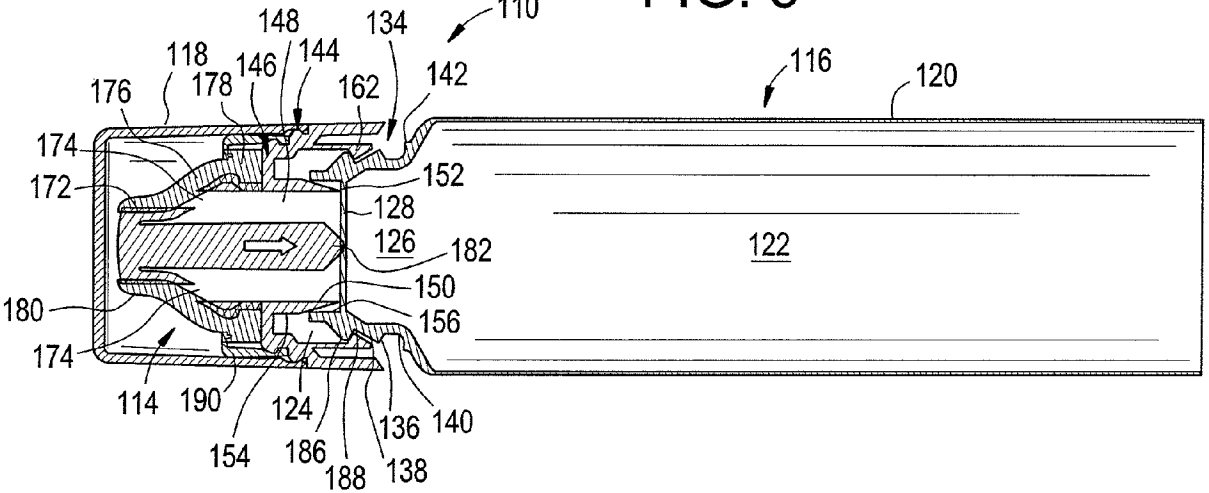
FIG. 5 is a cross-sectional view of a second embodiment of a kit of the present invention including a cap and one-way valve assembly that is pre-connected to the container, and movable between first and second positions for piercing the container to, in turn, connect the valve in fluid communication with the container and dispense substances therefrom.
Figure 6:
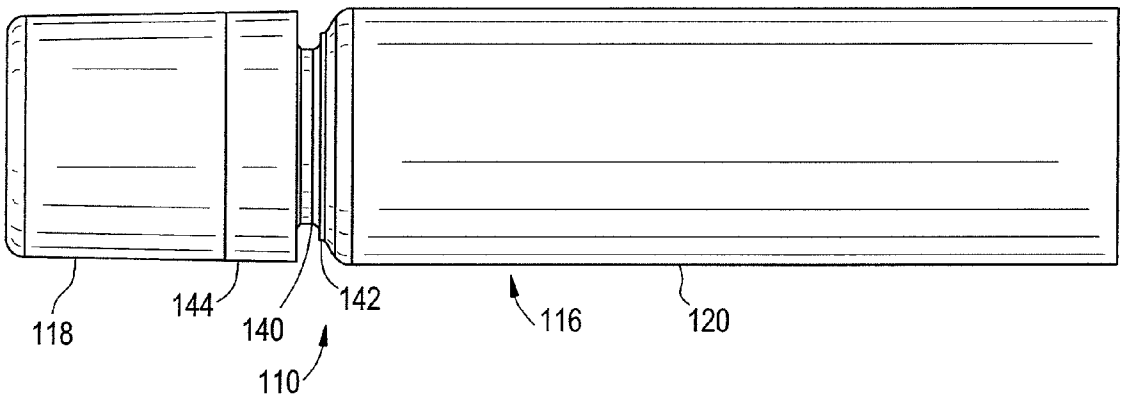
FIG. 6 is a side elevational view of the kit of FIG. 5 illustrating the cap and valve assembly in the first or storage position wherein the valve is not connected in fluid communication with the container.
Figure 7:
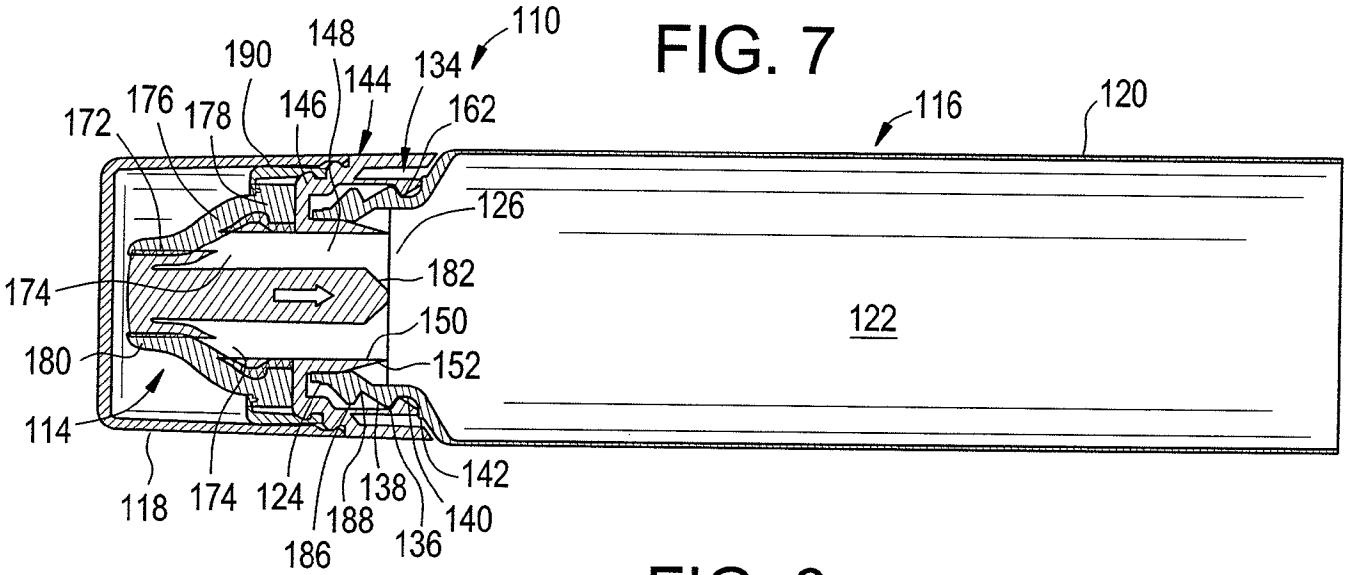
FIG. 7 is a cross-sectional view of the kit of FIG. 5 illustrating the cap and valve assembly in the second position wherein the valve is connected in fluid communication with the interior of the container for dispensing substances therefrom.
Figure 8:
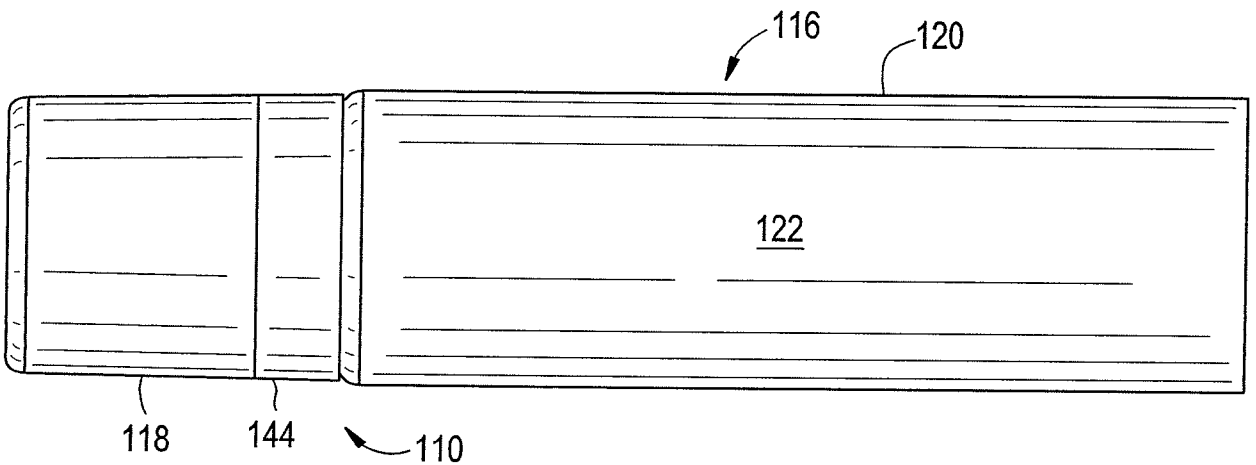
FIG. 8 is a side elevational view of the kit of FIG. 7 illustrating the cap and valve assembly in the second position.
Figure 9:
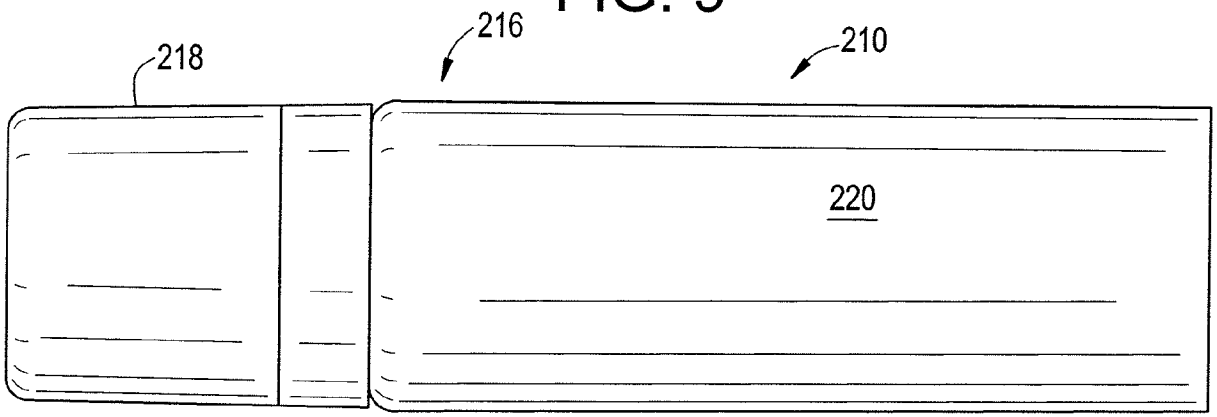
FIG. 9 is a side elevational view of another embodiment of a container and one-way valve assembly embodying another aspect of the present invention.

In FIGS. 5 through 8, another kit embodying the present invention is indicated generally by the reference numeral 110. The kit 110 is similar in many respects to the 10 described above, the therefore like reference numerals preceded by the numeral 1 are used to indicate like elements. A primary difference of the kit 110 in comparison to the kit 10 is that the valve assembly 114 is pre-connected to the container 116. As shown in FIG. 5, the first connection portion 134 of the tube 116 further includes a third raised portion or lobe 186 axially spaced relative to the first lobe 136, and the tapered surface 138 defines a second annular recess 188 therebetween. Thus, in the first position, the lobe 162 of the valve assembly is received within the second annular recess 188 of the tube. In this position, the valve assembly is connected to the tube, but the pierceable portion 128 of the tube is not broken, and the valve and storage chamber are not in fluid communication. However, the interior portions of the valve assembly, including the piercing portion 150, and the pierceable portion 128 of the tube, are sealed from the exterior of the kit, and thus are prevented from being exposed to any external sources of contamination. Accordingly, the needed for the releasable sealing members may be obviated. In addition, if desired, the empty kit can be sterilized with the valve and tube connected in the first position, such as by gamma sterilization. Then, when the user desires to use the kit, the valve assembly 114 is pressed axially inwardly toward the tube as indicated by the arrow in FIG. 5 (or vice-versa) to, in turn, pierce the pierceable portion 128 and connect the valve and storage chamber in fluid communication with each other. As shown in FIG. 7, in the second position the annular lobe 162 of the valve is received within the first annular recess 140 of the tube to fixedly secure the valve and tube in the second position. The substance is then dispensed by simply squeezing the tube to, in turn, deliver the desired amount of substance through the one-way valve.

In FIGS. 9-14, another container and one-way valve assembly embodying the present invention is indicated generally by the reference numeral 210. The container and one-way valve assembly 210 is similar in certain respects to the devices 10 and 110 described above, and therefore like reference numerals preceded by the numeral "2", or preceded by the numeral "2" instead of the numeral "1", are used to indicate like elements. A primary difference of the container and valve assembly 210 in comparison to the devices described above is that the container 216 does not include a pierceable wall and first releasable sealing member. Rather, in the illustrated embodiment, the one-way valve assembly 214 is connected to the head 224 of the container prior to filling the storage chamber 222 with the substance to be stored and dispensed therefrom. However, as my be recognized by those of ordinary skill in the pertinent art based on the teachings herein, the device 210 equally may include such pierceable walls and releasable sealing members, and be provided in kit form, in the same manner as either of the embodiments described above.

Figure 10:
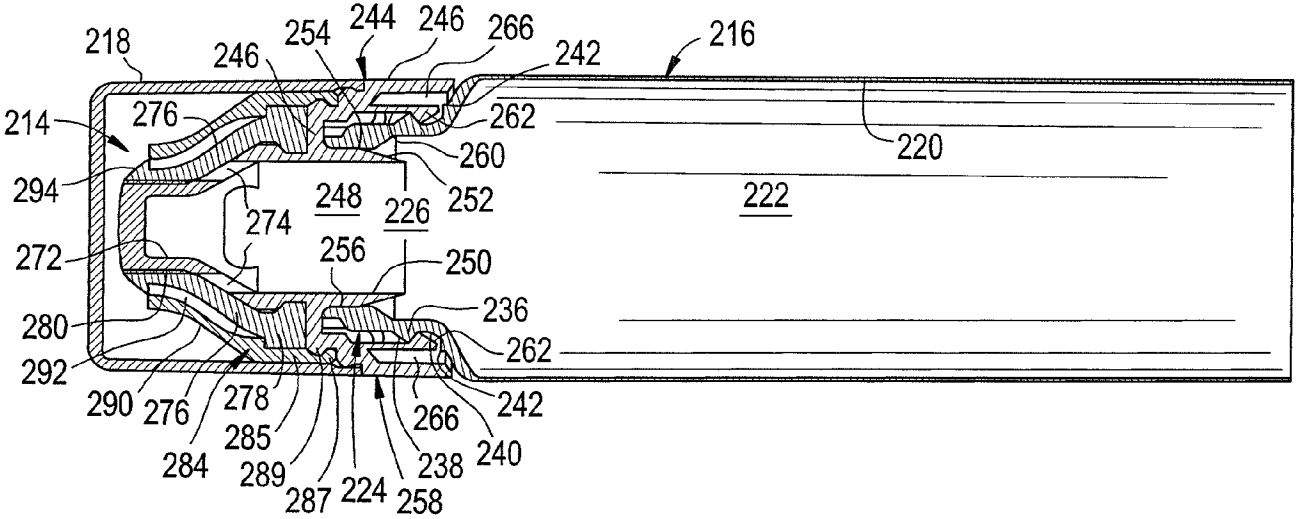
FIG. 10 is a cross-sectional view of the container and one-way valve assembly of FIG. 9.
Figure 11:
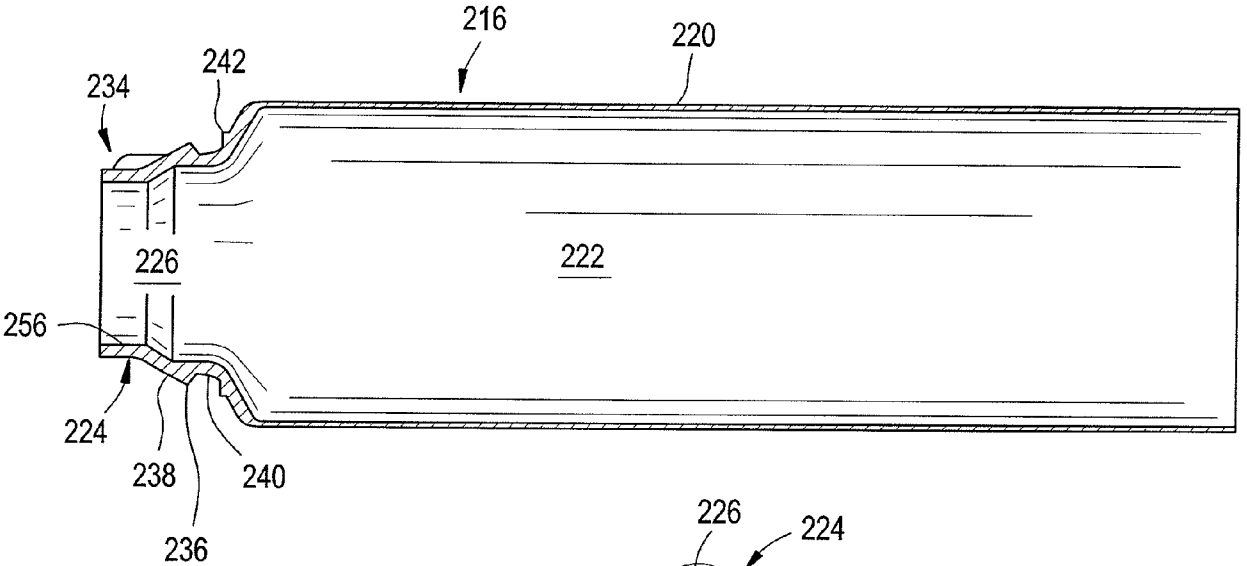
FIG. 11 is a cross-sectional view of the container of FIG. 9 prior to attachment of the one-way valve assembly thereto.

Another difference of the device 210 in comparison to the devices 10 and 110 described above, is that the securing ring 284 extends axially adjacent to the valve cover 276 to further prevent tampering with the valve and/or unwanted removal of the valve cover. As shown in FIG. 10, the securing ring 284 includes a base portion 285 defining therein an annular recess 287 that receives therein an annular lobe 289 formed on the valve body for snapping the securing ring to the valve body and fixedly securing the securing ring thereto. The securing ring 284 further defines an extension 290 that extends axially from the base 285 and adjacent to the valve cover 276. As can be seen, the extension 290 is spaced radially from the valve cover 276 to define an annular, and axially-extending gap 292 therebetween. Thus, the gap 292 permits the valve cover 276 to move radially outwardly between valve seat 272 and extension 276 during dispensing substance therethrough. The valve cover 276 defines on its distal end an annular flange 294 that extends over the distal end of the gap 292 to substantially prevent substances from flowing into, or otherwise collecting within the gap. Preferably, when the valve cover is expanded radially during dispensing, the annular flange 294 slidably contacts the adjacent end wall of the extension 290 to form a seal therebetween.

Figure 12:
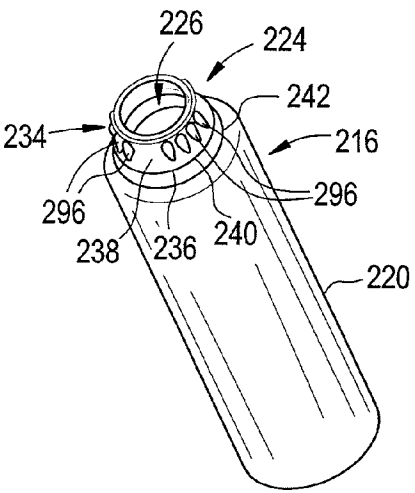
FIG. 12 is an upper perspective view of the container of FIG. 11.
Figure 13:
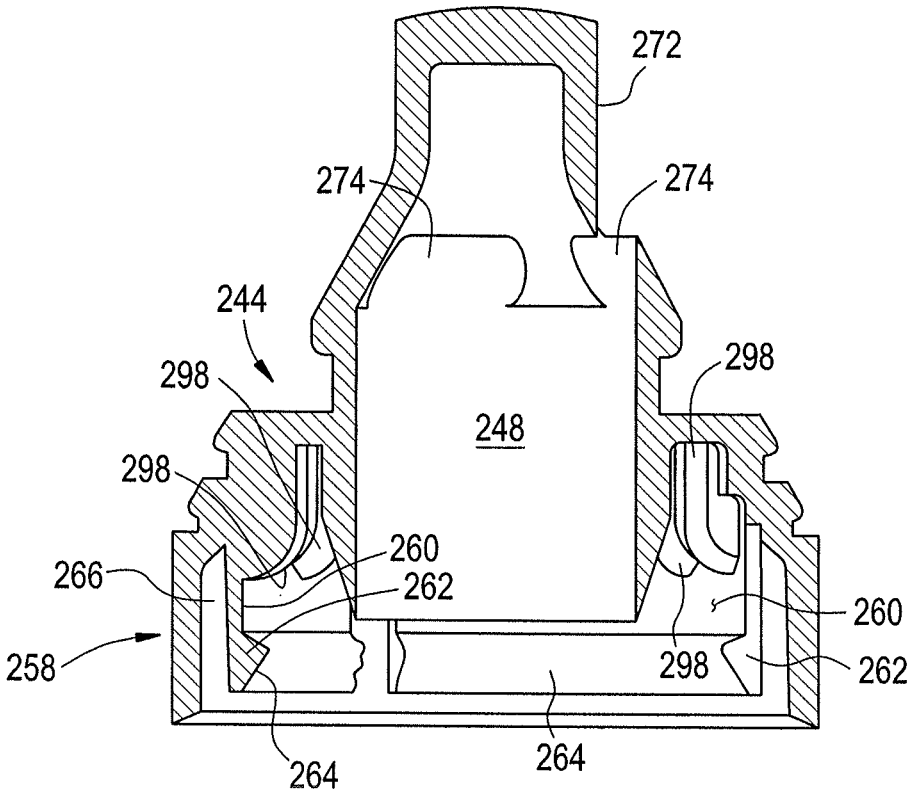
FIG. 13 is a cross-sectional view of the valve body of the one-way valve assembly of FIG. 9.

As shown in FIG. 12, the tube head 224 defines a plurality of angularly spaced first protuberances 296 formed on or adjacent to the first tapered surface 238. As shown typically in FIG. 13, the valve body 244 defines a plurality of corresponding second protuberances 298 that are angularly spaced relative to each other in the same manner as the first protuberances. When the valve assembly 214 is connected to the tube head 224, the first protuberances 296 are slidably received within the gaps of the second protuberances 298, and vice versa, to prevent relative rotation of the valve and tube when connected.

Figure 14:
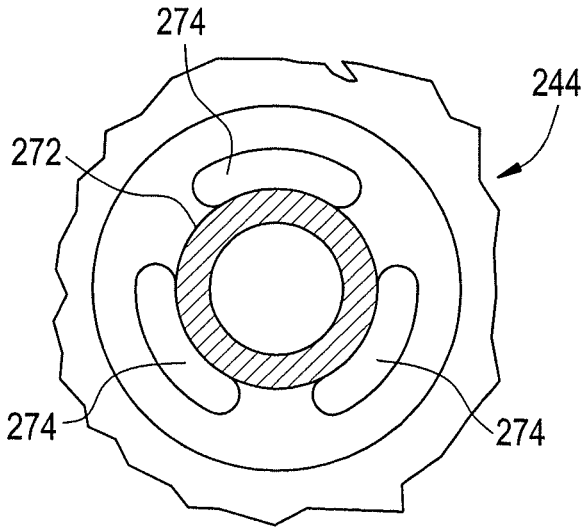
FIG. 14 is a partial, cross-sectional view of the valve body of FIG. 13.
Figure 15:
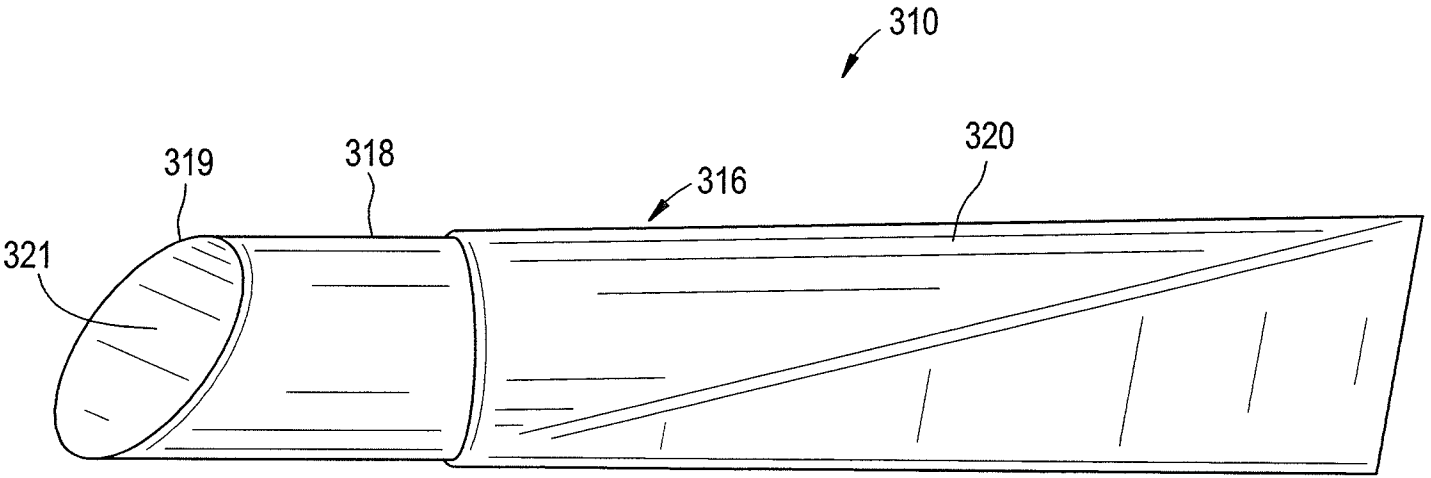
FIG. 15 is a side elevational view of another one-way valve and container of the invention particularly suited for applying products, such as cosmetics or cosmeceutical products, to a user's lips or other facial surfaces.
Figure 16:
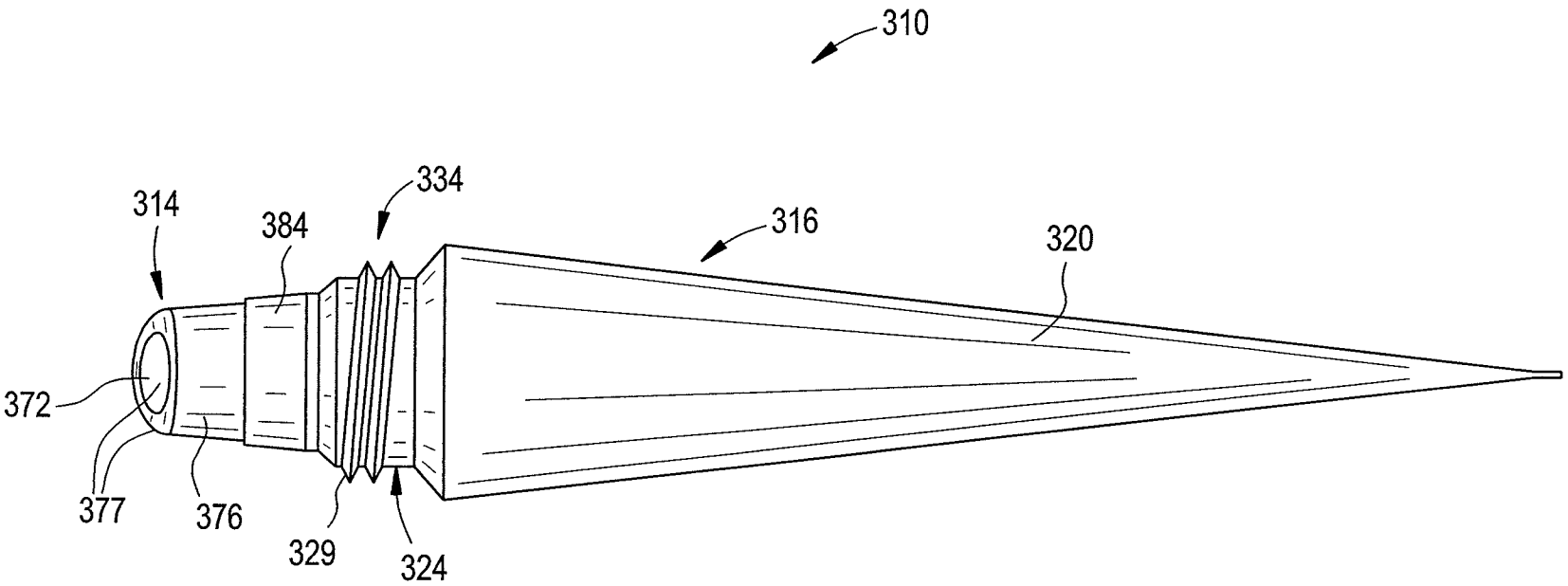
FIG. 16 is a side elevational view of the device of FIG. 15 with the cover removed.
Figure 17:
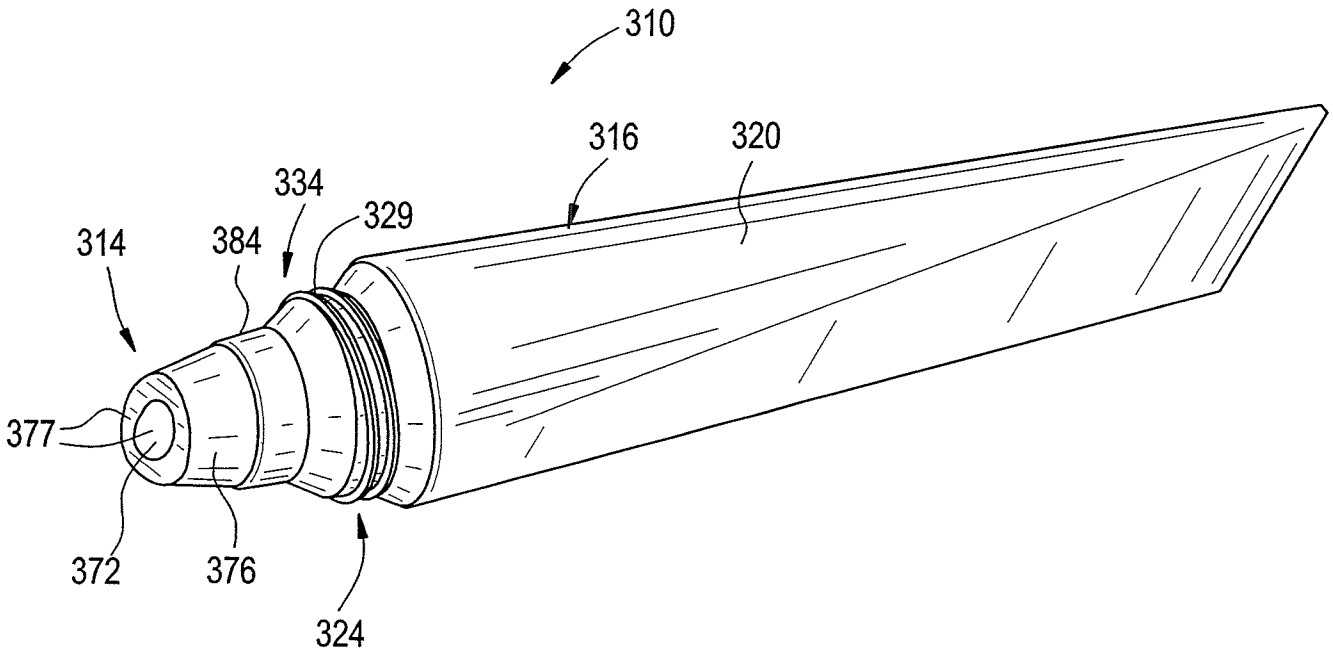
FIG. 17 is an upper perspective view of the device of FIG. 15 with the cover removed.

As shown in FIG. 14, the valve body 244 defines three angularly-extending flow apertures 274 that each extend angularly throughout an angle "A". In the illustrated embodiment, the angle A is approximately 90 degrees, and the apertures 274 are approximately equally spaced relative to each other. However, as may be recognized by those of ordinary skill in the pertinent art based on the teachings herein, the one-way valve assembly of the present invention may define any desired number of flow apertures, each flow aperture may define an angular extent different than that illustrated, and in those embodiments having more than one flow aperture, the flow apertures may define different sizes and/or shapes relative one another.

In FIGS. 15-18, another container and one-way valve assembly embodying the present invention is indicated generally by the reference numeral 310. The container and one-way valve assembly 310 is similar in certain respects to the device 310 described above, and therefore like reference numerals preceded by the numeral "3", instead of the numeral "2", are used to indicate like elements. A primary difference of the container and valve assembly 310 in comparison to the device 210 described above is that the valve cover 376 and valve seat 372 cooperate to define a curvilinear-shaped applicator surface 377 that is shaped to conformably contact a facial contour, such as a user's lips. As shown typically in FIG. 18B, the applicator surface 377 defines a substantially concave contour in cross-section, and is substantially defined by a radius "R". The illustrated applicator surface shape is particularly suited for applying, for example, liquid lipstick to a user's lips. However, as may be recognized by those of ordinary skill in the pertinent art based on the teachings herein, the device 310 may be used to apply any of numerous different products to any of numerous different types of surfaces, including without limitation, lip balms, medicines, or other products to a user's lips, or a concealer or other cosmetic or cosmeceutical product to other facial surfaces.

Figure 18A:
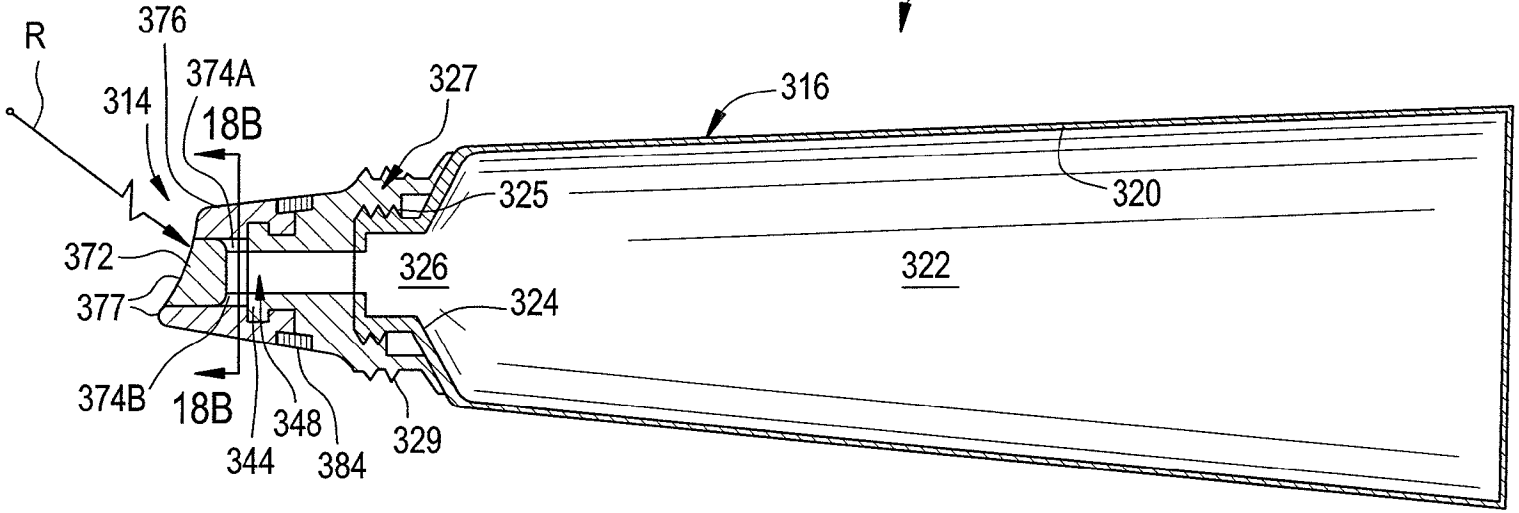
FIG. 18A is a cross-sectional view of the device of FIG. 15 with the cover removed.

Another difference of the device 310 in comparison to the device 210 described above, is that the one-way valve assembly 314 is screwed onto the head 314 of the container 316. As shown in FIG. 18A, the tube head 324 defines external threads 329, and the valve body 344 defines internal threads 327 that cooperate with the external threads 329 to fixedly secure the valve body to the tube head. In addition, the valve body 344 defines external threads 329 that threadedly engage the interior of the cap 318 to secure the cap to the valve and tube assembly. The cap 318 includes an angled end wall 319, and the angled end wall 319 preferably includes on its exterior a mirrored or like reflective surface 321 to allow a user to view her lips or other facial surface therein when applying the product dispensed onto the contoured applicator surface 377.

Figure 18B:
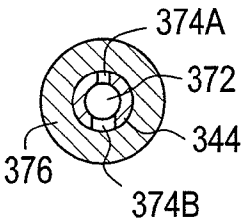
FIG. 18B is a cross-sectional view of the one-way valve assembly taken along line 18B-18B of FIG. 18A.

As shown in FIG. 18B, the valve body 344 defines first and second flow apertures 374A and 374B, respectively, wherein the second flow aperture 374B is larger than the first flow aperture 374A. As can be seen, the second flow aperture 374B defines approximately twice the angular extent of the first flow aperture 374A, and therefore is approximately twice as large as the first flow aperture. In the illustrated embodiment, the second or larger flow aperture 374B is aligned with the side of the valve cover 376 that extends axially outwardly further than the side of the valve cover aligned with the first flow aperture 374B. The hoop stress is lesser on the outlet end of the flow path aligned with the second flow aperture 374B (because the outermost portion of the valve cover at this point does not extend a full 360 degrees, but rather defines a lesser angular extent as shown), and therefore this portion of the valve may release a greater volume of substance therethrough at the same valve opening pressure in comparison to the other side of the valve. However, as may be recognized by those of ordinary skill in the pertinent art based on the teachings herein, this flow aperture configuration is only exemplary, and the device 310 may define any of numerous different flow aperture configurations that are currently or later become known. As can be seen, the valve cover 376 defines an interference fit, and tapered cross-sectional configuration as described in further detail above and in the above-mentioned co-pending patent applications incorporated herein by reference.

As may be further recognized by those of ordinary skill in the pertinent art based on the teachings herein, the one-way valve assembly may be connected to the container in the same manner as any of the other embodiments described above.

Figure 19:
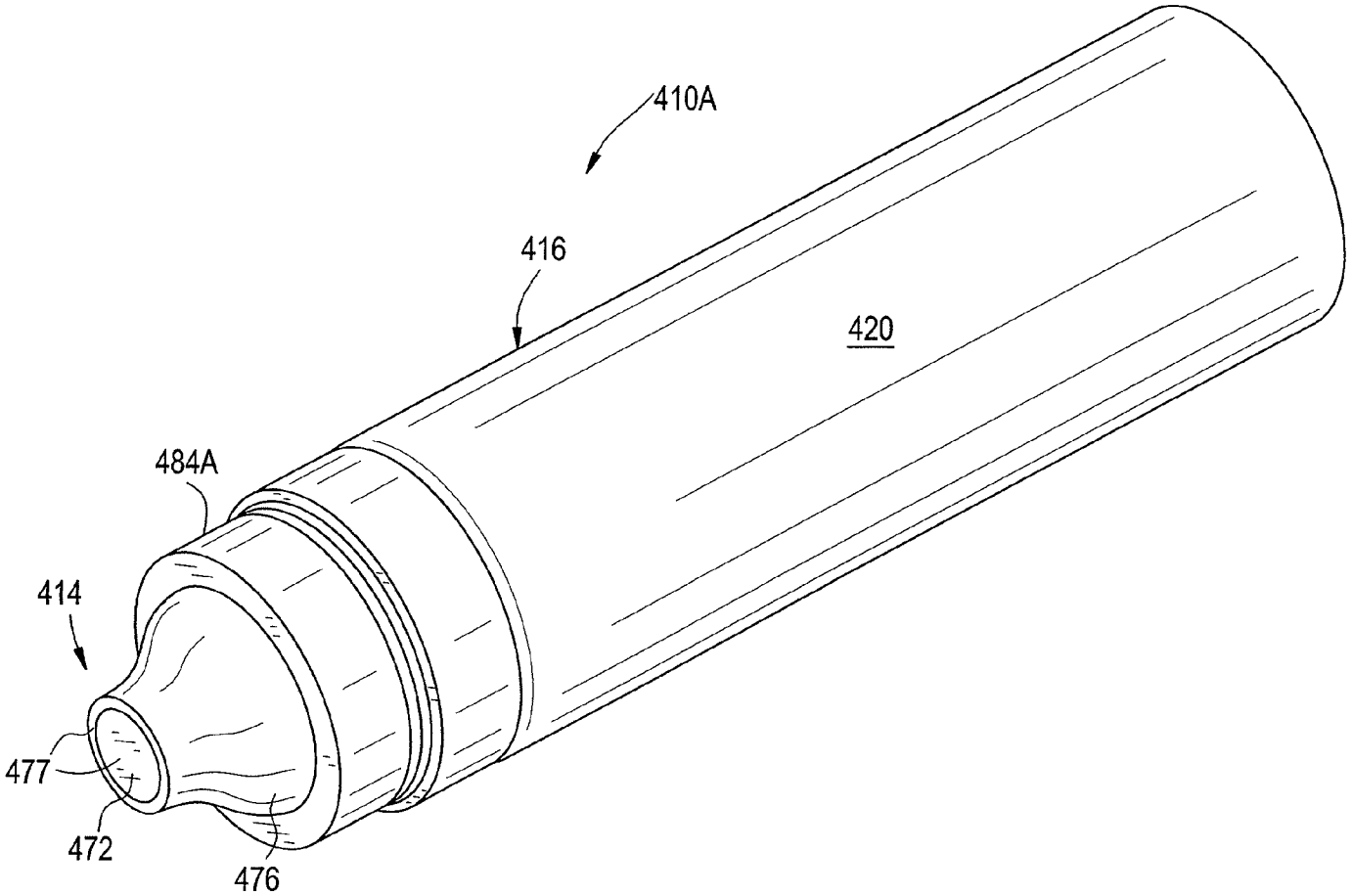
FIG. 19 is a perspective view of another one-way valve and container of the invention illustrating an alternative securing ring for preventing tampering.
Figure 20:
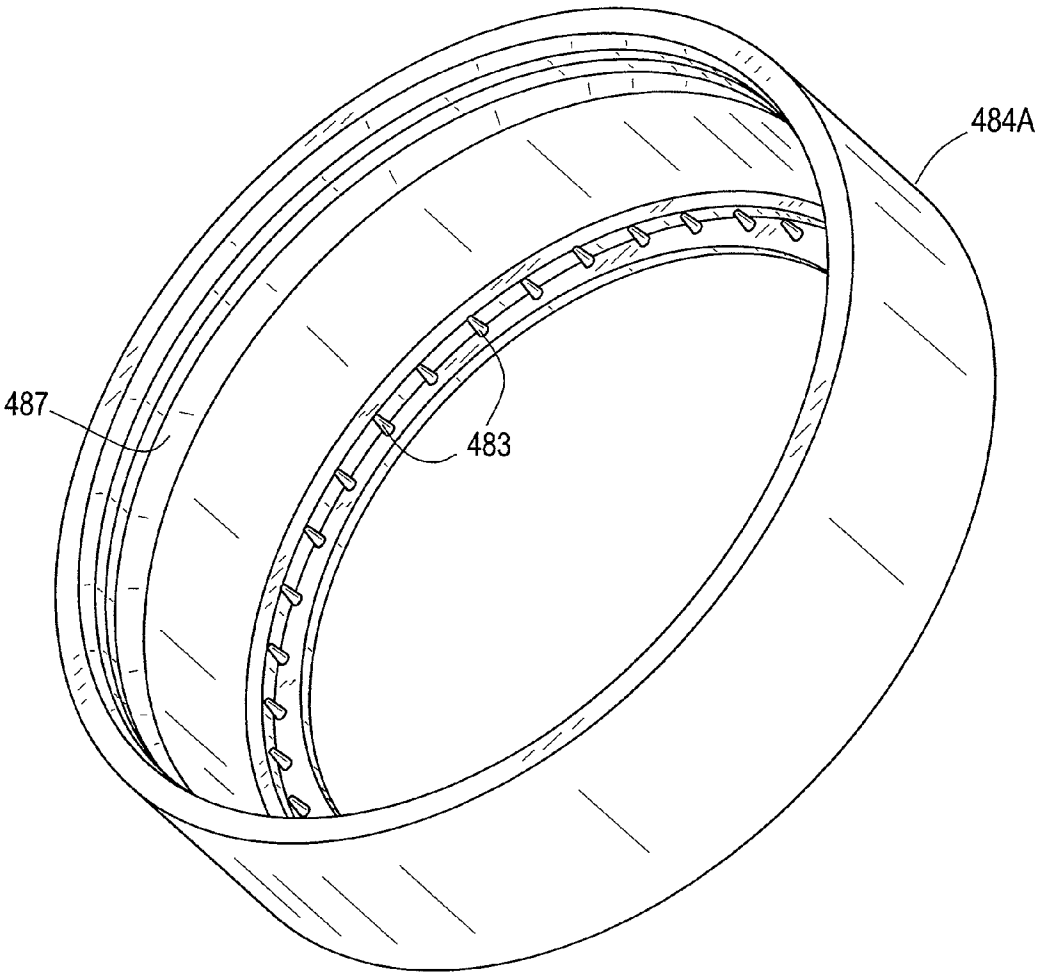
FIG. 20 is a perspective view of the securing ring of FIG. 19.

The securing rings employed in the devices of the present invention may take any of numerous different configurations that are currently or later become known. Turning to FIGS. 19-23, the devices are substantially similar to the devices described above, and therefore like reference numerals preceded by the numeral "4", or preceded by the numeral "4" instead of any of numerals "1" through "3", are used to indicate like elements. Each of the devices 410A through 410D includes a different securing ring 484A through 484D, respectively. As shown in FIGS. 19 and 20, the securing ring 484A does not include an extension portion, but rather engages the base of the valve cover 476 to fixedly secure the valve cover to the valve body. As shown in FIG. 20, the securing ring 484 includes a plurality of pointed protuberances that pierce or otherwise are pressed axially into engagement with the base of the valve cover 476 to fixedly secure the valve cover to the valve body. In addition, the securing ring 484 defines an annular recess 481 that is snapped over, and receives therein a corresponding annular protuberance (not shown) formed on the valve body to fixedly secure the securing ring to the valve body (with the protuberances 483 pressed axially into the base of the valve cover) and, in turn, fixedly secure the valve cover to the valve body.

Figure 21:
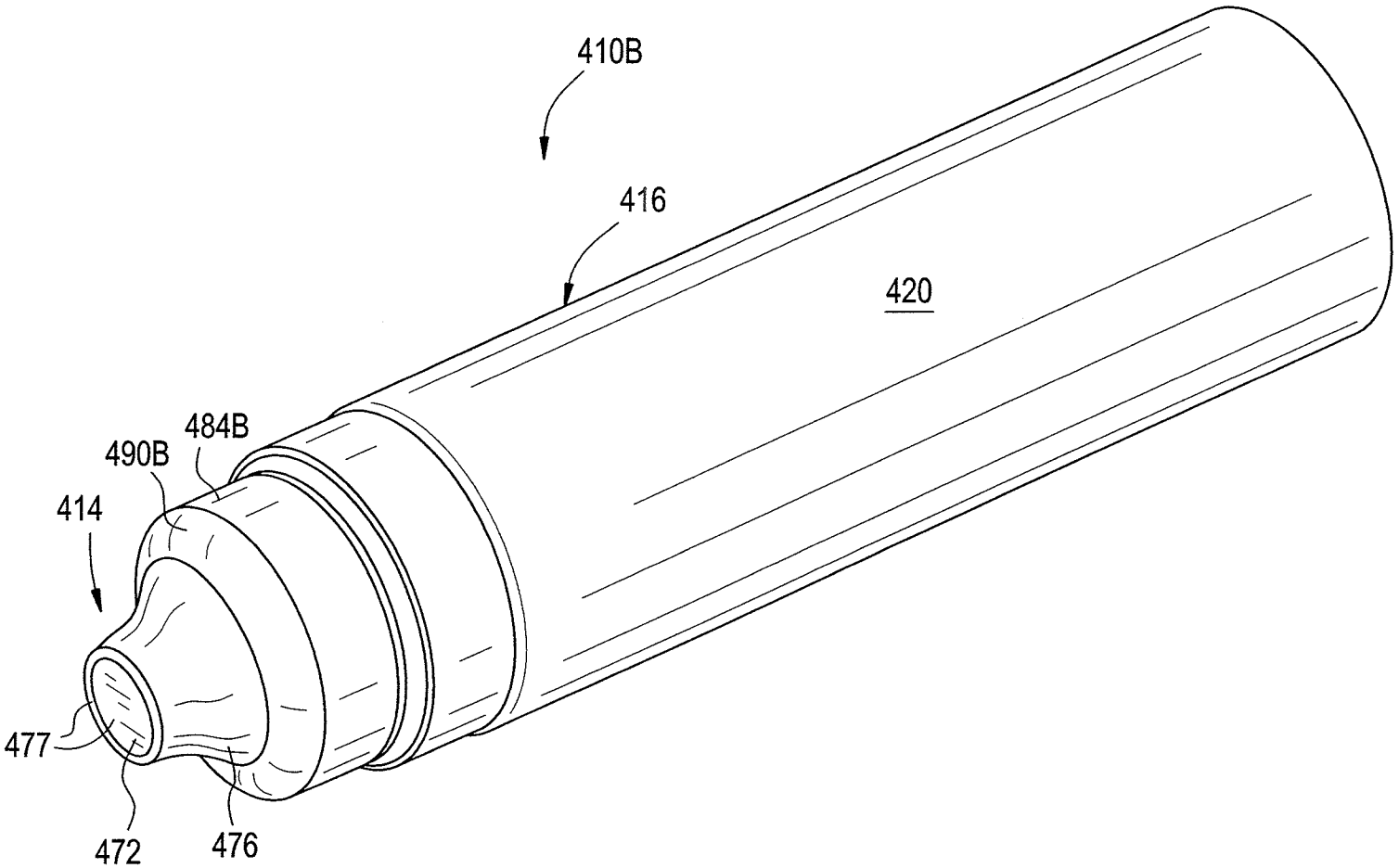
FIG. 21 is a perspective view of another one-way valve and container of the invention illustrating an alternative securing ring for preventing tampering.
Figure 22:
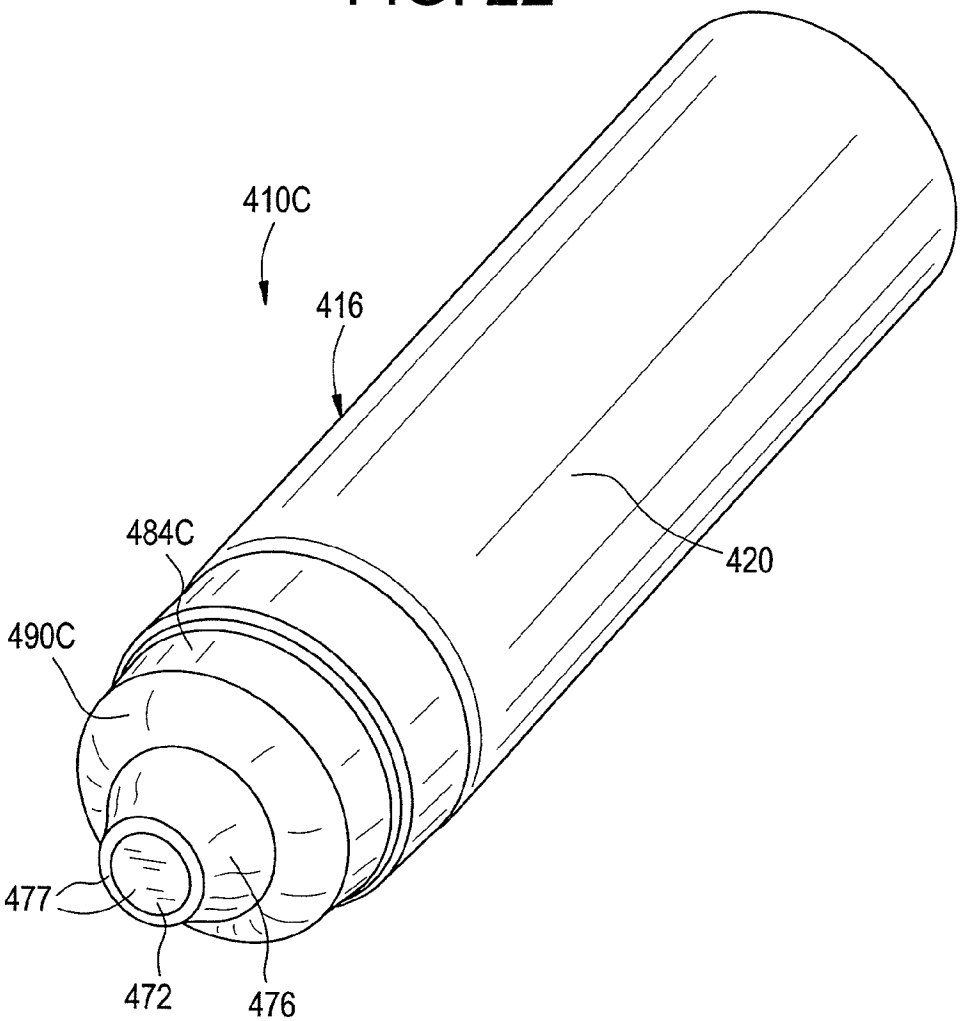
FIG. 22 is a perspective view of another one-way valve and container of the invention illustrating an alternative securing ring for preventing tampering.
Figure 23:
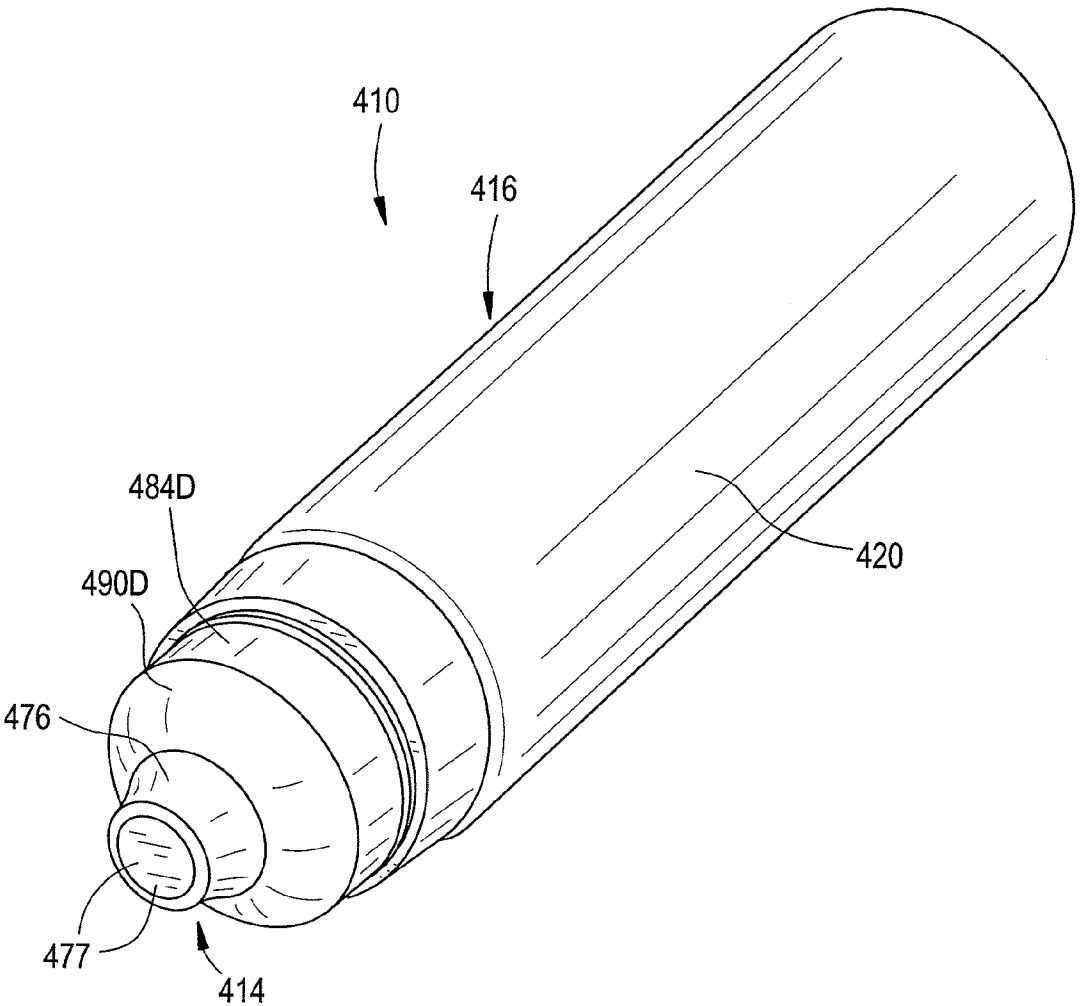
FIG. 23 is a perspective view of another one-way valve and container of the invention illustrating an alternative securing ring for preventing tampering.

As shown in FIG. 21, the alternative securing ring 484B includes an extension portion 490B that engages the adjacent outer surface of the valve cover 476 to further secure the valve cover to the valve body and prevent the valve cover from being peeled away, or otherwise removed from the valve body, or to prevent such tampering without notice of same. In FIG. 22, the extension 490C extends axially further over the valve cover 476 in comparison to the extension 490B, and in FIG. 23, the extension 490D extends axially even further over the valve cover 476 in comparison to the other extensions. In the embodiments of FIGS. 22 and 23, the outermost edge of the extension 490C or 490D preferably is aligned with or adjacent to the axially innermost edges of the flow apertures (not shown) so that the extensions do not prevent or otherwise constrain the flow of substance through the flow apertures and out of the valve. Alternatively, if the extensions 490 extend over the flow apertures, they are preferably spaced radially therefrom as described above in connection with the extension 290 illustrated in FIG. 10.

It is understood that valve assembly and container kit may include additional items or components. Additionally, the device could include a cap or like device that is fitted between the valve assembly and tube to pierce the tube and, in turn, connect the valve in fluid communication with the tube. In addition, the valve and container each may take any of numerous different configurations that are currently or later become known. For example, the valve may define a different shaped valve seat and/or valve cover. In one example, the valve seat may define a taper such that the valve seat defines a progressively increasing diameter moving in the direction from the interior to the exterior of the valve to thereby progressively decrease the valve opening pressure in this direction. Additionally, the container need not be tube shaped, but rather may take a different shape and/or configuration, such as another squeezable body shape or rigid body shape having a pump or other means of propulsion of the substance from the storage area through the valve. Further, the covers may take any of numerous different configurations that are currently or later become known. For example, each cover may include an annular protuberance on the inner side of the base wall of the cover that engages the adjacent end surface of the one-way valve cover when the container cover is closed to further prevent any undesirable seepage of substance through the valve if the tube is squeezed with the cover closed. Accordingly, this detailed description of the currently preferred embodiments is to be taken in an illustrative as opposed to a limiting sense.

There are a number of advantages of the one-way valve assembly and container kits disclosed herein. By having the valve assembly separate from the container, the containers that have been used in the past to provide the various substances can continue to be used. Thus, for substances and containers that require regulatory approval for the containers, new approvals are not necessary. At most, the head of the container may be reshaped so as to be able to fit with the valve assembly. Accordingly, the same type of container can continue to be utilized and the valve assembly is added, which then prevents the ingress of bacteria or other contaminants into the container during and after dispensing.

In addition, by adding the valve assembly, the substance inside the container can remain free of contamination and the substance can be stored in a substantially airless environment even after the substance has been dispensed. Accordingly, because the substance can be stored in a substantially airless environment, it is not necessary to add any preservatives to the substance in order to prevent spoilage or contamination.

Another advantage of the kit of the present invention is that the valve assembly prevents any contamination of the substance contained within the container during storage and throughout usage of the kit (i.e., from the first to the last dose). Another advantage of the present invention is that the kit may be used to store and deliver multiple doses of preservative-free substances because the substance can be maintained in a sterile, hermetically-sealed, airless condition, throughout storage and usage of the device. Yet another advantage of the present invention is that the container may be essentially same as the containers currently being used by drug or other manufacturers, thus obviating the need for time consuming and potentially costly studies of container stability during product shelf life.

This patent application discloses subject matter that is similar to that disclosed in U.S. patent application Ser. No. 10/640,500, filed Aug. 13, 2003, entitled "Container And Valve Assembly For Storing And Dispensing Substances, And Related Method", and U.S. patent application Ser. No. 29/174,939, filed Jan. 27, 2003, entitled "Container and Valve Assembly:, and U.S. patent application Ser. No. 29/188,310, filed Aug. 15, 2003, entitled "Tube and Valve Assembly", U.S. patent application Ser. No. 29/191,510, filed Oct. 7, 2003, entitled "Container and Valve Assembly," all of which are incorporated herein by reference as part of the present disclosure.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims.

What is claimed is:

1. A device for storing and dispensing a substance comprising:

a container comprising a body including therein a storage chamber for receiving and storing a substance, a pierceable wall located in fluid communication with the storage chamber, and a first connecting portion for connecting another component thereto; and a dispensing portion including:

a second connecting portion configured to connect to the first connecting portion for securing the dispensing member to the container;

at least one piercing portion engageable with the pierceable wall; and a fluid passageway extending through the dispensing portion, wherein:

at least one of the dispensing portion and the container are movable relative to the other between a first position and a second position, in the first position, the at least one piercing portion is not piercing the pierceable wall, when moving from the first position to the second position, at least one of the first connecting portion and the second connecting portion moves relative to the other, and the piercing portion engages and pierces the pierceable wall, and in the second position, the second connecting portion is connected to the first connecting portion and secures the dispensing member to the container and forms a fluid tight seal therebetween, and the piercing portion is piercing the pierceable wall and the storage chamber is in fluid communication with the fluid passageway for allowing a flow of substance from the storage chamber therethrough and out of the device.

2. A device as defined in claim 1, wherein, in the first position, the pierceable wall seals the storage chamber with respect to the ambient atmosphere.

3. A device as defined in claim 1, wherein the storage chamber is a variable-volume storage chamber.

4. A device as defined in claim 1, wherein the dispensing portion is one of (i) secured to and (ii) not secured to the container in the first position.

5. A device as defined in claim 1, wherein the at least one piercing portion has an annular, axially-extending piercing surface that projects into the pierceable wall upon movement between the first and second positions.

6. A device as defined in claim 5, wherein the piercing surface tapers inwardly.

7. A device as defined in claim 1, wherein at least one of the first and second connecting portions defines an annular raised portion, and the other defines an annular recessed portion for receiving therein the annular raised portion to, in turn, connect the dispensing portion and container to the other.

8. A device as defined in claim 1, wherein at least one of the first and second connecting portions defines two annular recessed portions axially spaced relative to each other, and the other defines an annular raised portion receivable within the annular recessed portions for connecting the dispensing portion to the container, and wherein the first annular recessed portion defines the first position and the second annular recessed portion defines the second position.

9. A device as defined in claim 1, wherein the first and second connecting portions define a snap connection.

10. A device as defined in claim 1, wherein the first and second connecting portions define a threaded connection.

11. A device as defined in claim 1, wherein the second connecting portion moves axially with respect to the container between the first position and the second position.

12. A device as defined in claim 1, wherein the container comprises a second passageway that is in fluid communication with the storage chamber and defines a flow path therethrough.

13. A device as defined in claim 1, wherein in the first position the fluid passageway of the dispensing portion is hermetically sealed with respect to the storage chamber.

14. A device as defined in claim 1, further comprising at least one releaseable sealing member releasably connected to the body and configured to prevent contamination of the pierceable wall.

15. A device as defined in claim 1, further comprising at least one releaseable sealing member releasably connected to the dispensing portion and configured to prevent contamination of the piercing portion.

16. A device as defined in claim 1, wherein the fluid passageway defines an axially-extending fluid passageway through the at least one piercing portion.

* * * * *